US008308153B2

(12) United States Patent
De Marco et al.

(10) Patent No.: US 8,308,153 B2
(45) Date of Patent: Nov. 13, 2012

(54) TRANSVERSAL CUTTING EQUIPMENT FOR SHEETS SEPARABLE FROM OVERLAPPED CONTINUOUS FORMS

(75) Inventors: Giuliano De Marco, Ivrea (IT); Armando Aprato, Ivrea (IT); Francesco Terrusi, Ivrea (IT); Alberto Massucco, Ivrea (IT); Francesco Modica, Ivrea (IT)

(73) Assignee: Tecnau S.r.l., Ivrea (Torino) (IT)

( * ) Notice: Subject to any disclaimer, the term of this patent is extended or adjusted under 35 U.S.C. 154(b) by 104 days.

(21) Appl. No.: 12/980,439

(22) Filed: Dec. 29, 2010

(65) Prior Publication Data

US 2011/0210495 A1 Sep. 1, 2011

(30) Foreign Application Priority Data

Dec. 30, 2009 (IT) ..... TO2009A1062

(51) Int. Cl.
*B65H 33/12* (2006.01)

(52) U.S. Cl. ..... 270/52.09; 271/3.17; 271/270; 271/9.1; 270/58.17; 270/58.07; 270/52.12

(58) Field of Classification Search ..... 270/58.07, 270/58.17, 52.17, 52.07, 52.09, 52.12; 271/9.01, 271/9.1, 3.17, 270
See application file for complete search history.

(56) References Cited

U.S. PATENT DOCUMENTS 3,693,486 A * 9/1972 Maniaci et al. ..... 83/88
5,104,104 A * 4/1992 Mol ..... 270/52.08
5,297,783 A * 3/1994 Howard et al. ..... 270/52.12
6,062,556 A * 5/2000 McCay ..... 271/9.13
6,125,730 A 10/2000 Jacques
6,341,773 B1 1/2002 Aprato et al.
6,460,842 B1 * 10/2002 Koelle ..... 270/58.01
6,460,844 B1 * 10/2002 Clifford et al. ..... 271/9.13
2008/0128984 A1 * 6/2008 Sussmeier et al. ..... 271/270

FOREIGN PATENT DOCUMENTS

EP 1741653 1/2007
WO 0128903 4/2001

OTHER PUBLICATIONS

Search Report received in corresponding Italian Application No. TO2009A001062, filed on Dec. 30, 2009.

* cited by examiner

*Primary Examiner* — Patrick Mackey
(74) *Attorney, Agent, or Firm* — Banner & Witcoff, Ltd.

(57) ABSTRACT

A transversal cutting equipment for sheets separable from overlapped continuous forms, wherein the forms are longitudinally divided from a basic continuous form for producing documents with a single sheet or more sheets, and wherein the documents and the respective sheets are printed according to a predetermined order. The equipment comprises a cutting device for joined separation of the sheets; an accumulating and forwarding device; transport paths; and differentiating means for modifying the transport times of the sheets along one or more transport paths. The cutting device operates in a continuous way, while the accumulating and forwarding device collects the sheet or sheets of a partially formed document and sends the sheet or sheets upon the completion of the document. The differentiating means modifies the transport times without interrupting the cutting device so that a cut sheet of a following document, is transferred to the accumulating and forwarding device for the formation of the following document, substantially after the forwarding of the preceding document.

18 Claims, 9 Drawing Sheets

V
51h
A12
49h
56h
57
T

V
51l
A13
49l
56l
57
T

A1
V
51h
A22
49h
56h
59
56h
57
T

V
51l
A11
49l
56l
57
T

A2
V
51h
A33
49h
56h
59
56h
57

V
51l
A21
49l
56l
57
T

TRANSVERSAL CUTTING EQUIPMENT FOR SHEETS SEPARABLE FROM OVERLAPPED CONTINUOUS FORMS

CROSS REFERENCE TO RELATED APPLICATIONS

This application claims priority to Italian Application No. TO2009A001062, filed Dec. 30, 2009, and entitled "Transversal Cutting Equipment for Sheets Separable from Overlapped Continuous Forms," the content of which is incorporated herein by reference in its entirety.

FIELD OF THE INVENTION

The present invention relates to transversal cutting equipment for sheets separable from overlapped continuous forms.

More specifically, the invention relates to a transversal cutting equipment for sheets separable from overlapped continuous forms of paper webs, wherein the forms are longitudinally divided from a basic continuous form for producing documents with a single sheet or more sheets, wherein the documents and the respective sheets are printed according to a predetermined order, and wherein the sheets are transversely cut and longitudinally extracted and moved.

BACKGROUND OF THE INVENTION

Equipments of this type, commercially known as double cutters, are used in systems for the automatic processing of documents previously printed on the continuous forms.

The double cutters can operate "on-line", downstream from slitting equipments, known as "merger" which divide the basic forms in longitudinal sense, or can operate "off-line" on, already separated, independent forms.

The double cutters of known type cause the forms to advance contemporarily or in alternate way and provide to separate, by means of a single blade, the printed sheets, single or overlapped, for the forming of the documents and the following processing. Moreover, the cutters can trim the edges of the separated forms when the form of origin is provided of lateral feed holes or for reduce the width of the form. For reason of cost and operative flexibility, cutting devices are used having blades with movement of alternative type, for instance guillotine like, and therefore providing the arrest of the form in association with the cutting.

In the case of use of a double cutter, on-line with the slitting equipments, the forms emerging from the merger have the same velocity which is substantially constant, while the forms entering the cutter have varying instantaneous velocity, associated to the intermittent motion of the form internally to the cutter. For compensating the differences of velocity, the portions of the forms between cutter and merger have a length greater than the distance between cutter and merger, so as to form two extended loops.

The operational speed of the commercial cutters is conditioned by the velocity of the cutting device and the stresses to which the entering forms are subjected. Particularly good results have been obtained with the cutting equipment described in the Patent Italian N. 1.360.399 [EP 1 741 653], assigned to Tecnau S.r.l. This equipment provides additional loops of reduced length, upstream of the cutting device and uniformed velocity of the forms at the input of the equipment. It allows reaching the limit determined by the cutting device for the separation of overlapped sheets. Nevertheless, the overall productivity is less of that theoretical, when one of the forms should be arrested for the production of documents having an odd number of sheets or for a particular arrangement of the documents in the unseparated form. Moreover, the differentiated motion of the forms, after the longitudinal separation, renders more difficult to make uniform the velocity of the forms at the input of the equipment.

U.S. Pat. No. 6,341,773, also assigned to Tecnau S.r.l., discloses a dynamic sequencer for sheets of printed paper including a cutting equipment. The documents are printed according to a predetermined order with pages arranged in a flanking relationship, while the sequencer provides to overlap the separated sheets on a collecting station. The various sheets are separated by a transversal and longitudinal cutting equipment which operates on the full width of the form, while two extractors extract the separated sheets from the cutting equipment. For documents including pages arranged on flanked sheets, both the extractors are actuated for the simultaneous extraction and movement of the sheets. For flanked sheets belonging to different documents only one of the extractors is actuated for the advancing of the respective sheet and completing the first document. The other sheet of the second document is extracted by the other extractor upon the releasing of the first document. Therefore, also this cutting equipment should be arrested for the production of documents having an odd number of sheets or for particular arrangements of the documents. Further, the cutting equipment and the associated sequencer are cumbersome in view of used transport belts, which extend longitudinally and have components divergent in height and components converging in height and toward the longitudinal axis.

SUMMARY OF THE INVENTION

An object of the invention is to accomplishing a transversal cutting equipment for overlapped continuous forms, of compact dimensions, high operational velocity and in which the overlapped entering forms are moved in synchronism, independently of the arrangement of the sheets and the documents in the unseparated basic form.

Another object of the invention is to accomplishing a transversal cutting equipment, with intermittent motion, for overlapped continuous forms, of high reliability and velocity and that provides, for the entering forms, stable loops with minimal dimensional variations.

According to these objects, the cutting equipment comprises a cutting device, actuatable for the joined separation of the sheets from the overlapped forms, an extractor device for extracting and moving forwards sheets separated by the cutting device, an accumulating and forwarding device for the document, transport paths, downstream of the extractor device, for transporting the separated sheets, along overlapped paths, to the accumulating and forwarding device; and differentiating means for modifying the transport times of the sheets along one or more transport paths. The cutting device and the extractor device operate in continuous way, while the accumulating and forwarding device collects the sheet or the sheets of a partially formed document and sends the sheet or the sheets upon the completion of the document, while the differentiating means temporarily modify the transport times so that a cut sheet of a following document, different from the partially formed document, is transferred to the accumulating and forwarding device for the formation of the following document, substantially after the forwarding of the preceding document.

The characteristics of the invention will become clear from the following description given purely by way of non-limiting example, with reference to the appended drawings in which:

DESCRIPTION OF THE PREFERRED EMBODIMENTS

Figure 1:
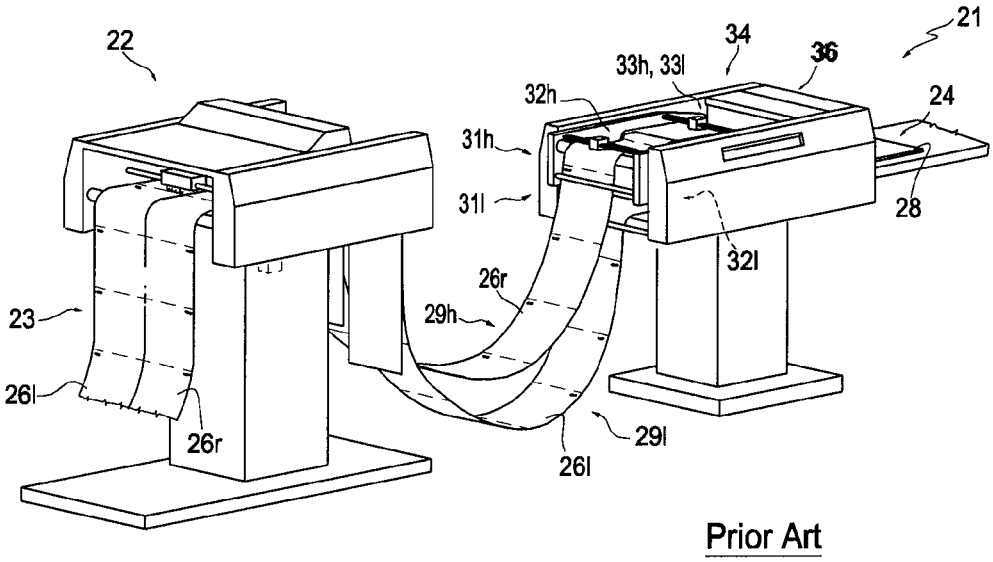
FIG. 1 is a schematic view of a cutting equipment for overlapped forms and a longitudinal slitting equipment of known type.

FIG. 1 shows a cutting equipment or double cutter 21 for overlapped forms and a longitudinal slitting equipment or merger 22, which operate on a paper strip or basic continuous form 23. The cutter 21 and the merger 22 are of known type and belong to a system, not represented, for the automatic processing of documents 24.

The merger 22 longitudinally divides the form 23 defining two continuous forms, respectively a left form 26*l* and a right form 26*r*, in which the forms 26*l* and 26*r* emerge side by side from the merger 22 and enter overlapped the cutter 21. The cutter provides to transversally cut the forms 26*l* and 26*r* for the separation of sheets 28 of the document and, optionally, to trim the edges thereof.

The merger 22 causes the forms 26*l* and 26*r* to emerge with continuous motion, while the cutter 21 draws the forms with intermittent motion. To compensate the differences of the instantaneous velocities, the sections of the forms 26*l* and 26*r* interposed between the merger 22 and the cutter 21 are arranged so as to form two extended loops 29*h* and 29*l*. An accumulating and forwarding device (not shown), downstream of the cutter, picks up the cut sheets of the document for the following processing, for instance in a folder/inserter equipment.

Figure 2:
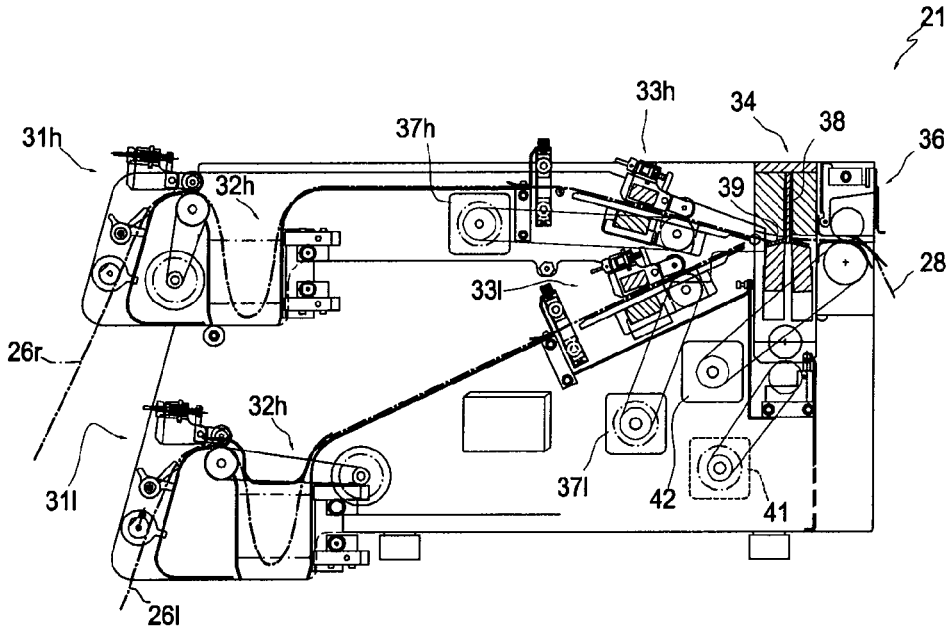
FIG. 2 shows schematically a sectioned side view of the cutting equipment of FIG. 1.

In extreme synthesis, the cutter 21 (FIG. 2) comprises introduction devices 31*h* and 31*l*, loop forming devices 32*h* and 32*l*, dragging devices 33*h* and 331, a cutting device 34 and an extraction and trimming device 36. Specifically, the cutter 21 and its components are of the type described in the above-mentioned Italian Patent N. 1.360.399 [EP 1 741 653], herein incorporated by reference.

The introduction devices 31*h* and 31*l* cause the forms 26*r* and 26*l* to advance at uniform velocity in the case in which both the forms advance for forming documents with an even number of pages. If the forms should be alternated, one of the introduction devices causes the form which should proceed to advance in the usual way, while the other device progressively arrests the form which should be arrested.

The known cutting device 34 includes a guillotine like blade 38 and a counter-blade 39. The blade 38 is actuated by a cutting motor 41 through a transmission member with toothed belt and pulleys and a, not represented, mechanism of eccentric type. The extraction and trimming device 36, downstream of the cutting device 34, provides to quickly extracting the separated sheets 28 and trimming the edges thereof. In detail, the extraction and trimming device 36 comprises extraction rollers for the cut sheet or the cut sheets, which cooperate frictionally with the sheet or sheets and two pair of rotating blades moved by an extraction motor 42.

The cutter 21 and the merger 22 are components of a system receiving sheets printed on the continuous forms, which, after separation constitute the pages of the various documents. According to current standard, the sheet or the sheets belonging to a given document and the various documents are printed according to a predetermined order on columns arranged side by side on the basic continuous form.

The accumulating and forwarding device provides the stacking of the sheets from the high to the low or from the low to the high and the forwarding of the formed document for the following processing. The arrangement of the sheets is such that, after the separation and the transfer to the accumulating and forwarding device, the order of the pages generally results a natural order, with the first page at the top in the stack which constitutes the document. For stacking of the sheets from the high to the low, the arrangement of the sheets, in the basic form 23 (FIG. 4), follows an order, which is regressive with respect to the feeding direction "F". Vice versa, for stacking from the low to the high, the arrangement of the sheets (FIG. 5) follows a progressive order.

Figure 4:
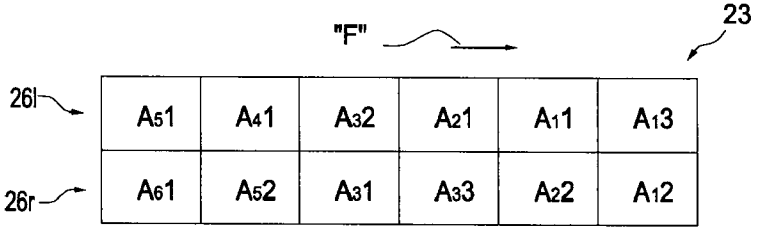
FIG. 4 is a schematic view of a continuous form according to a given arrangement of sheets for the forming of documents.
Figure 5:
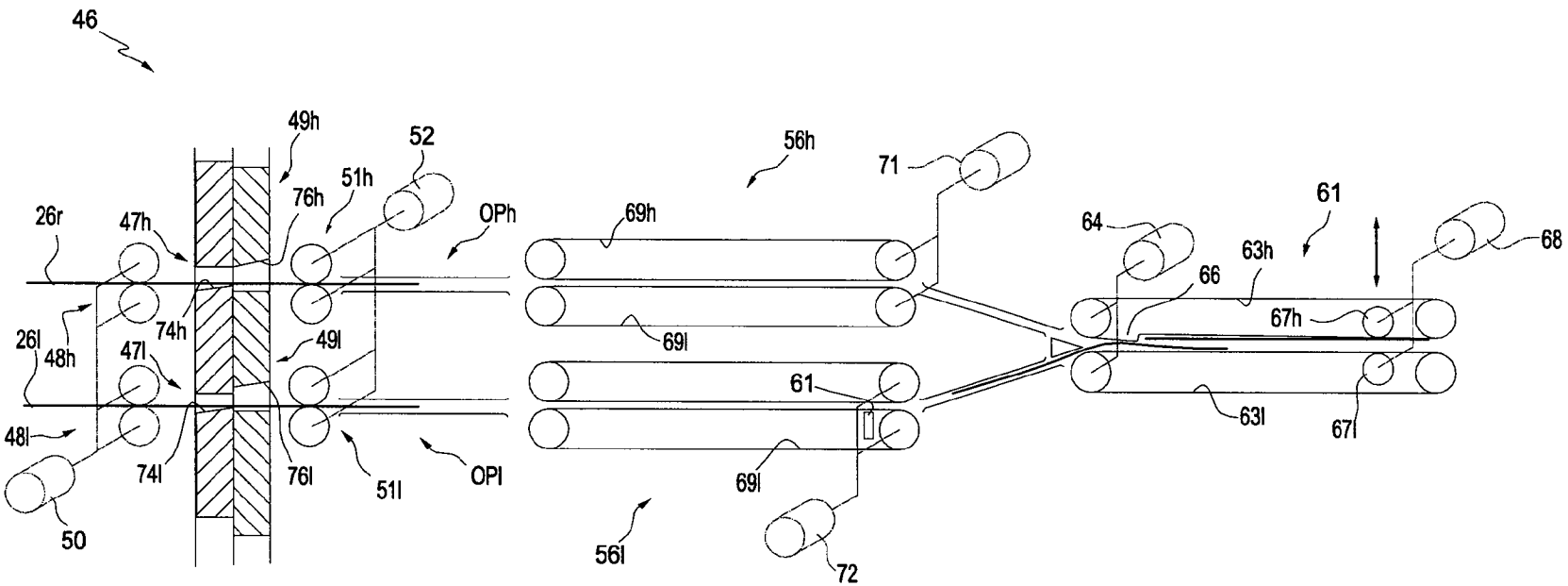
FIG. 5 represents a schematic view of a cutting equipment for sheets separable from overlapped forms, according to a first embodiment of the invention and an alternative configuration.

In the example of FIG. 4, the basic form 23 is of origin for the left form 26*l* and the right form 26*r*. In the cutter 21 (FIG. 2), the left form 26*l* will engage the lower mechanism 26*l*, while the right form 26*r* will engage the upper mechanism 26*h*. On the basic form 23, documents with different numbers of sheets: A1 (three sheets A11, A12, A13); A2 (two sheets A21 and A22); A3 (three sheets A31, A32, A33); A4 (a single sheet A41); A5 (two sheets A51, A52); and A6 (a single sheet A61) are printed, in regressive order.

For the forming of the document A1, the form 26*r* is arrested, after the joined cutting of the sheets A13, A12, for the cutting of the single sheet A11 (with loss of the parity), its overlapping on the cut sheets and the removal of the document; then, in sequence, there are advanced and arrested: first the form 26*r* for the cutting of the sheet A22 (returning to the parity) and beginning of the document A2, then the form 26*r* for the cutting of the sheet A21 (loss of the parity), the overlapping on the already cut sheet and the removal of the document A2. Now, with arrest of the form 26*l*, the form 26*r* advances for the cutting of the sheet A33 (returning to the parity) and, together, the forms 26*r* and 26*l* advance for the cutting of the sheets A32 and A31 (maintenance of the parity). After overlap of the sheets and removal of the document, the form 26*l* is let advance for the cutting of the sheet A41 (loss of the parity) and, after removal of the document A4, the form 26*r* is let advance for the cutting of the sheet A52 (returning to the parity), then advancing of the form 51*l* for the cutting of the sheet A51 (loss of the parity) and removal of the document A5. It follows the advancing of the form 51*r* for the cutting of the sheet A61 (returning to the parity) and removal of the document A6.

Figure 6:
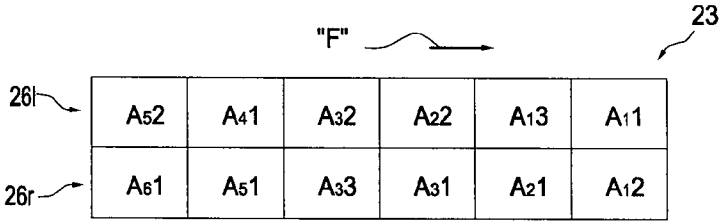
FIG. 6 is a schematic view of a continuous form according to an alternative arrangement of sheets and documents.

In the example of FIG. 6, the basic form 23 is of origin for the left form 26*l* and the right form 26*r* and the same documents A1-A6 of FIG. 4, but in which the pages are printed in progressive order. In the cutter 21, the left form 26*l* will engage the upper mechanism, while the right form 26*r* will engage the lower mechanism. The cuttings of the sheets and the removals will follow the same logic followed for the documents of the example shown in FIG. 4.

It is clear that, with respect to the number of cuttings strictly necessary for the separation of the sheets (six cuttings in the examples of the FIGS. 4 and 6), a double cutter of known type should normally execute some additional cuttings (three in above mentioned examples) for the cuttings of the single forms. It causes a clear reduction of the total productivity, when the speed limit of the equipment is the one determined by the velocity of the cutting device.

Figure 3:
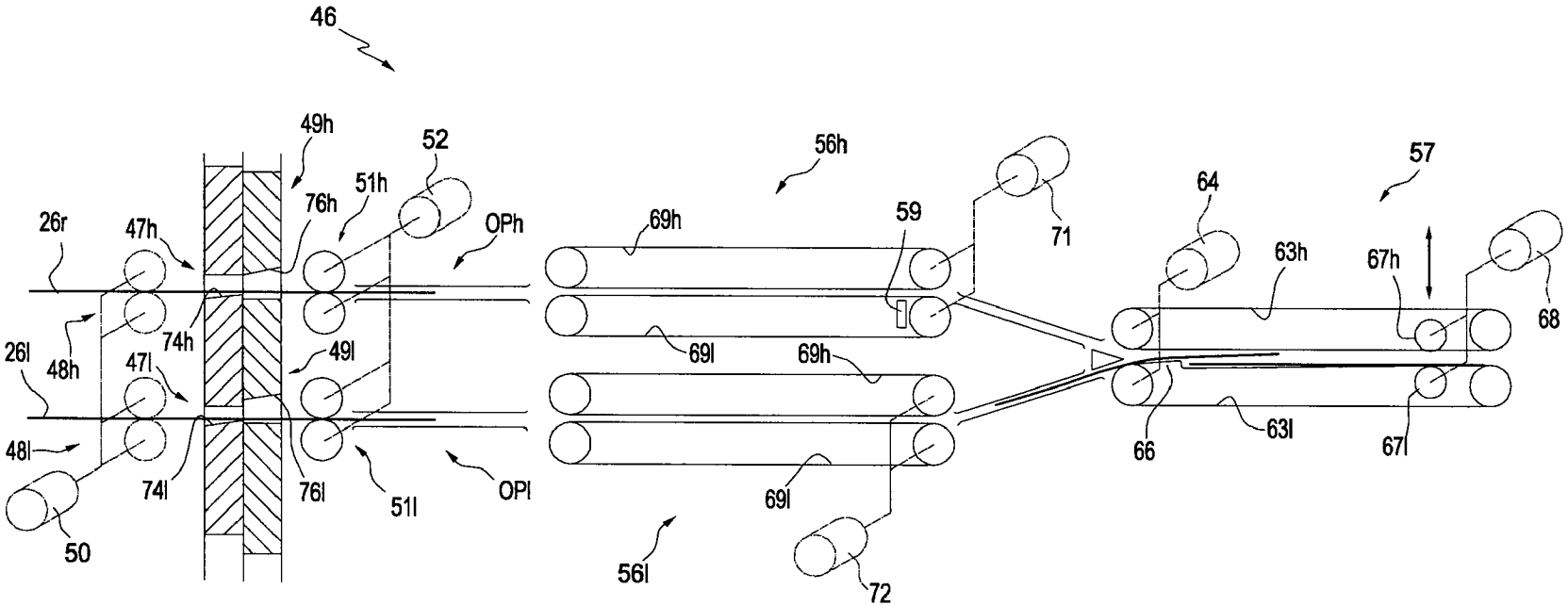
FIG. 3 represents a schematic view of a cutting equipment for sheets separable from overlapped forms, according to a first embodiment of the invention and a reference configuration.

According to the invention, the cutting equipment, represented with 46 in FIG. 3, processes overlapped continuous forms, (for instance the forms 26*l* and 26*r*), coming for longitudinal separation from a basic form (the form 23) with sheets and printed documents second a predetermined order (regressive), on tiled columns of the basic form.

The principle which is on the basis of the present invention is to enable a cutting device and an extraction device to advance always both the forms and the cut sheets in the usual way and to solve the loss of the parity of the overlapped forms downstream of the cutting device and the extraction device.

Insofar, according to an embodiment of the invention, the equipment 46 comprises inputs 47*h* and 47*l*, input mechanisms 48*h* and 48*l* and a cutting device including cutting mechanisms 49*h* and 49*l* for the overlapped continuous forms 26*r* and 26*l*, an extraction device including extraction members 51*h* and 51*l* or an extraction and trimming device including extraction and trimming members, transport paths 56*h* and 56*l*, inclined guides 60*h* and 60*l*, an accumulating and forwarding device 57 for the separated sheets, and differentiating means 58 for modifying the transfer times of the sheets along at least one of the transport paths. The inputs 47*h* and 47*l* are arranged in a condition of overlap and spaced away the one by the other, while the input mechanisms 48*h* and 48*l* cause the forms to advance through the inputs toward the cutting mechanisms along paths at different heights.

The input mechanisms 48*h* and 48*l* are driven by a common advancing motor 50, while the cutting mechanisms 49*h* and 49*l* are driven by a, not shown, cutting motor. The extraction members 51*h* and 51*l* or the extraction and trimming members are actuatable by an extraction motor 52, in synchronism with the cutting motor, for the single separation of the sheets from the overlapped forms. The transport paths 56*h* and 56*l* are arranged downstream of the cutting mechanisms 49*h* and 49*l* and the extraction members 51*h* and 51*l* and are provided for transporting the cut sheets along separated paths "OPh" and "OP1", also at different heights. The guides 60*h* and 60*l* are inclined, respectively, to the low and the high for guiding the sheets of the transport paths 56*h* and 56*l* toward the accumulating and forwarding device 57. In this first embodiment of the invention, the differentiating means 58 includes a stopping member 59, arranged along one of the transport paths 56*h* or 56*l* and actuatable for selectively arresting a cut sheet before its merging into the device 57.

Conveniently, the cutting mechanisms 49*h* and 49*l* and the extraction members 51*h* and 51*l* operate in continuous way. The accumulating and forwarding device 57 is configurable between a state of forming and a state of forwarding: In the state of forming, the accumulating and forwarding device 57 can receive and stacking the sheet or the group of sheets of a document in formation separated by the cutting device. In the state of forwarding, the device of 57 releases and sends the sheet or the group of stacked sheets of the formed document for the following processing. The stopping device 59 temporarily arrests a cut sheet of a following document different from the document in formation, and transfers the sheet to the accumulating and forwarding device for forming the following document after the forwarding of the preceding document.

As for the regressive arrangement of documents in FIG. 4, the right form 26*r* (FIG. 3) is introduced, through the input 47*h*, by the input mechanism 48*h* along the higher path 56*h*, while the left form 26*l* is introduced, through the input 47*l*, by the input mechanism 48*l* along the lower path 56*l*. The accumulating and forwarding device 57 provides to stack the separated sheets from the high to the low. The stopping member 59 is arranged along the higher path "OPh" of the transport path 56*h*.

As for documents arranged in progressive way, the right form 26*r* (FIG. 5) is introduced by the input mechanism 48*l* along the lower path 56*l*, while the left form 26*l* is introduced from the low to the high by the input mechanism 48*h* along the higher path 56*h*. In this configuration, the accumulating and forwarding device, represented with 61, provides to stack the separated sheets from the low to the high while the stopping member, represented with 62, is arranged along the lower path "OP1" of the transport path 56*l*.

A switchable accumulating and forwarding device can be provided for being switched between the configuration with stacking from the low, and the configuration with stacking from the high. For this switchable device (not shown), the differentiating means modifies the transfer times of the sheets of both the transport paths 56*h* and 56*l* for temporarily modifying the transfer times in dependence on the regressive or progressive order of the documents and the corresponding forming of the documents. Thus, according to the described embodiment, both the stopping member 59 and the stopping member 62 can be present.

The accumulating and forwarding device 57, 61, and the switchable accumulating and forwarding device, are of known type. In synthesis, as for what it concerns the stacking of the sheets, each accumulating and forwarding device comprises transport O-rings 63*h* and 63*l*, respectively higher and lower, controlled by an accumulating motor 64 and a step over ramp 66. As for the forwarding of the documents, the accumulating and forwarding device 57 includes rollers 67*h* and 67*l* controlled by an advancing motor 68 and having possibility of mutual movement between the configuration of forming of the device, in which the rollers are spaced away, and the configuration of forwarding in which the rollers engage the sheets of the formed document for the advancing toward the following processing.

The separation of the documents A1-A6 of FIG. 4 by means of the equipment of the invention 46 (FIG. 3) provides the feeding of the left form 26*l* through the input 47*l* and the feeding of the right form 26*r* through the input 47*h*, while the cutting mechanisms 49*h* and 49*l* contemporarily execute the cuttings on all the pairs of overlapped sheets. After the cutting, the extraction members 51*h* and 51*l* provide to the simultaneous advancing of the separated sheets, making space on the cutting device for the cutting, without interruption, of the following sheets.

Figure 7A:
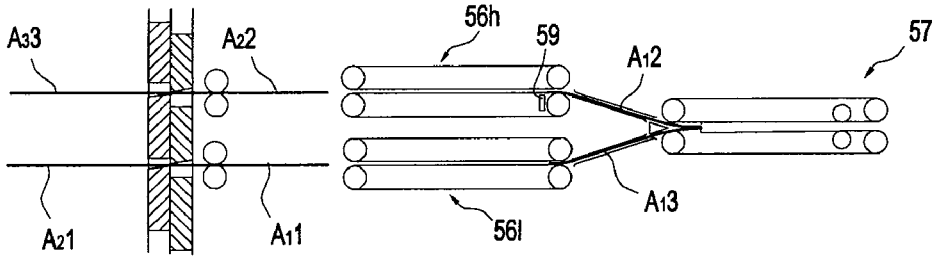
FIGS. 7*a*-7*h* show different operative conditions of the equipment of FIG. 3.
Figure 7B:
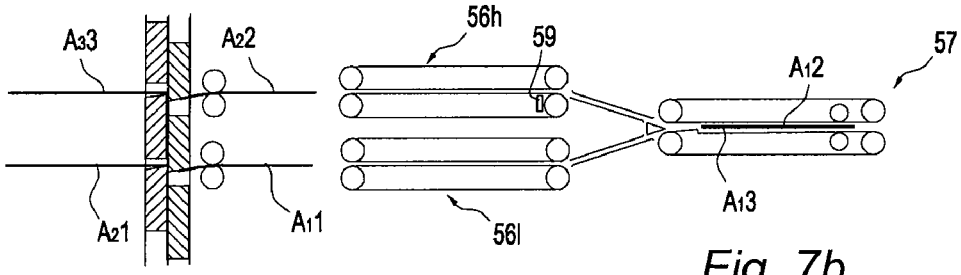

With reference to the FIGS. 7*a*-7*h* and FIGS. 8*a*-8*f*, for the forming of the document A1, after the cutting, the sheets A13 and A12 are extracted together, transferred along the transport paths 56*l* and 55*h* (FIG. 7*a*) and stacked by the accumulating and forwarding device 57, in the state of forming, as represented in FIG. 7*b*. In detail, the sheets A13 and A12 are temporarily arrested for the execution of the cutting by the cutting mechanisms 49*l* and 49*h* (FIGS. 8*a* and 8*b*), drawn out by the extraction members 51*l* and 51*h* or the extraction and trimming members, transported at high velocity by the transport paths 56*l* and 56*h* and are arrested by the accumulating and forwarding device 57.

Figure 7C:
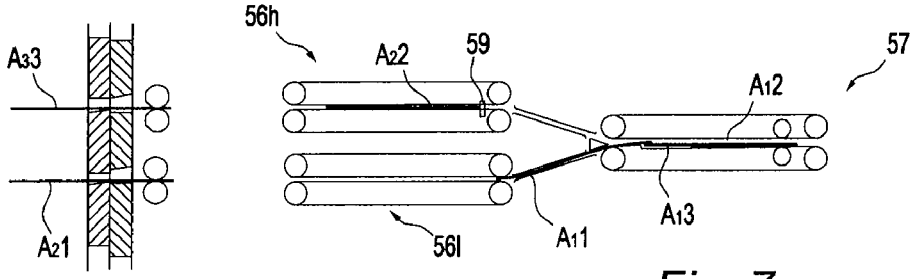
Figure 7D:
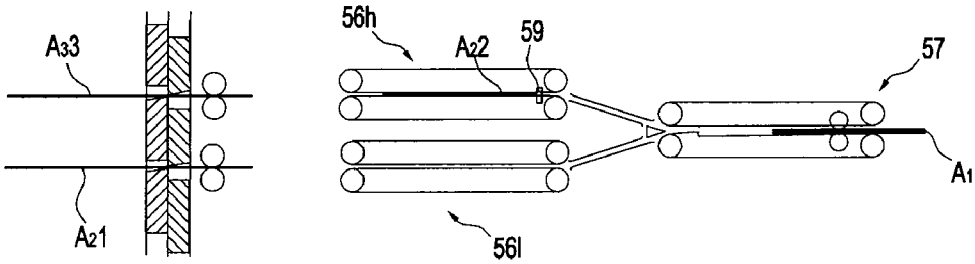
Figure 7E:
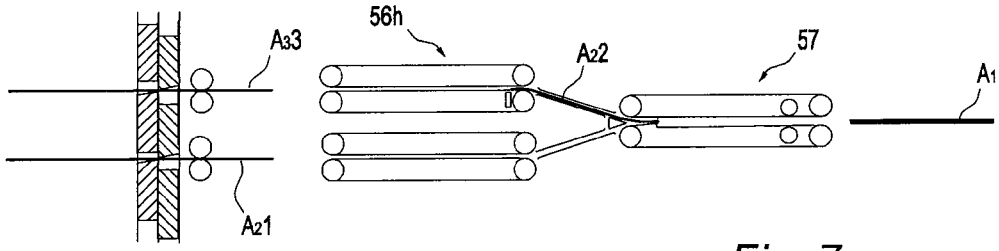
Figure 7F:
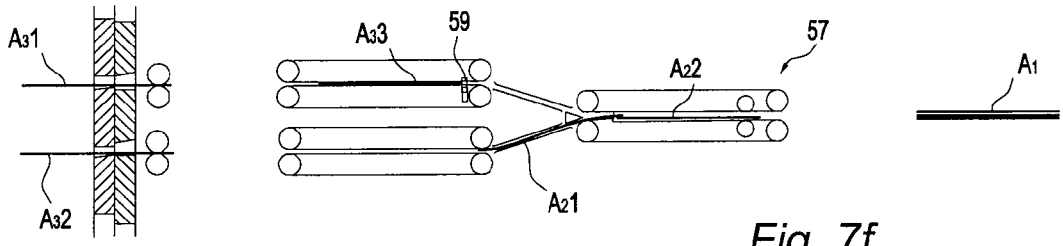
Figure 7G:
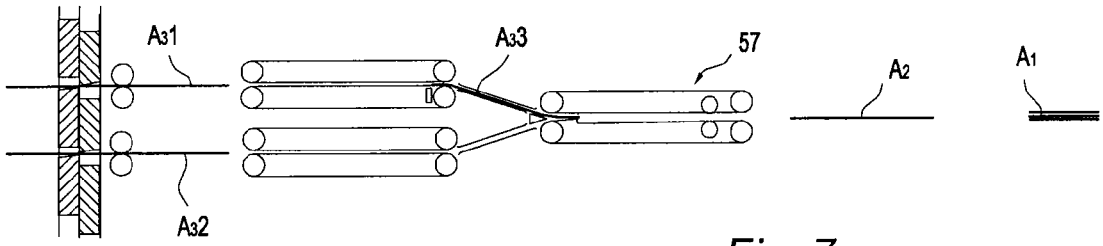
Figure 7H:
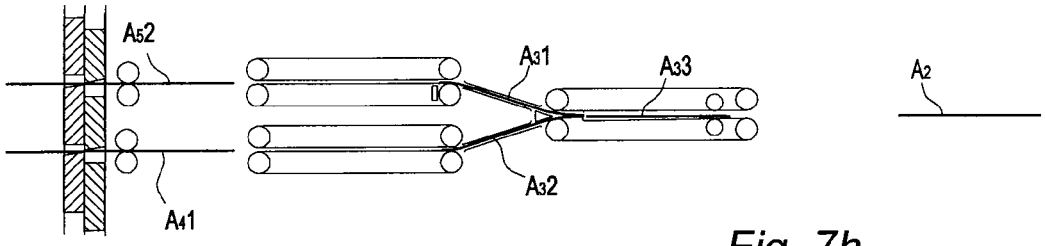
Figures 8A, 8B, 8C, 8D, 8E, 8F:
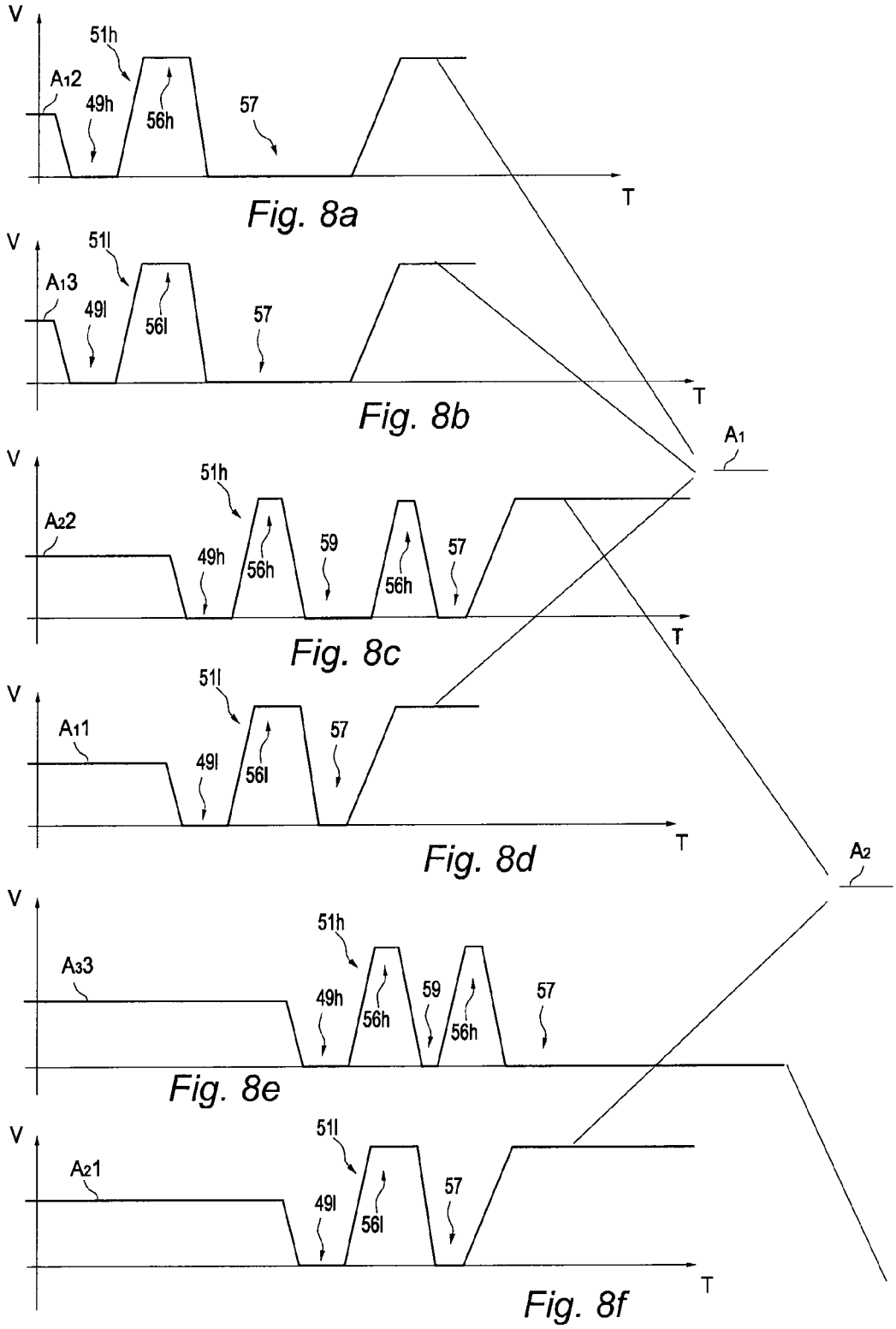
FIGS. 8*a*-8*f* represent velocity/time diagrams of some sheets of the form of FIG. 4 processed by the equipment of the invention.

Upon the following cutting of the sheets A11 and A21, the sheet A11 continues to be moved along the transport path 56*l* to overlap the cut sheets of the accumulating and forwarding device 57 in the state of forming (FIG. 7*c* and FIGS. 8*c* and 8*d*), while the sheet A22 is arrested (loss of parity) by the stopping device 59 (FIG. 7*c*). The device 57 releases, at high velocity, the document A1 (FIG. 7*d*) and returns to the state of forming (FIG. 7*e*), while the transport path 56*h* transfers, at high velocity, the sheet A22 into the accumulating and forwarding device (restoring of parity). After the cutting and the extraction or extraction and trimming of the sheets A21 and A33, the sheet A21 overlaps the sheet A22, while the sheet A33 (FIG. 7*f* and FIGS. 8*e* and 8*f*) is arrested (loss of parity); the accumulating and forwarding device 57, in the state of forwarding, releases the document A2, at high velocity, returns to the state of forming and receives the sheet A33 (FIG. 7*g*). Further, the sheets A32 and A31, after the cutting, are transferred into the accumulating and forwarding device 57 (FIG. 7*h*).

After the cutting and the extraction or extraction and trimming of the sheets A41 and A52 and the release of the document A3, in not shown phases, the sheet A41 proceeds along the street 56*l* and engages the accumulating and forwarding device 57 in the state of forming, while the sheet A52 is arrested by the stopping device 59. The device 57, in the state of forwarding, releases the document A4 while, in the state of forming, it receives the sheet A52 released by the stopping device. Upon the cutting of the sheets A51 and A61, the sheet A51 and A61 engage the accumulating and forwarding device 57: the sheet A51 proceeds and is released as document A5 together with the sheet A52, while, in sequence, the sheet A61 is arrested by the device 57 in the state of forming and subsequently forwarded as document A6.

From the above, it should be evident that the cutting equipment 46 according to the invention executes, without interruption, a number of cuttings for the separation of the sheets (six cuttings in the examples of the FIGS. 4 and 5) equal to the theoretical number of cuttings. It ensures an overall productivity of the cutter only limited by the velocity of the cutting device 49*h*, 49*l*.

In detail, the transport paths 56*h* and 56*l* include each one belts of transport 69*h* and 69*l*, respectively upper and lower, controlled by motors 71 and 72. The separated sheets are engaged between the belts 69*h* and 69*l* and are dragged frictionally for the action of the motors 71 and/or 72. The stopping devices 57 and/or 61 are constituted by teeth actuated by electromagnets or other similar components, not shown in the figures.

In alternative, the delay and/or arrest of a sheet can be obtained by modifying the law of motion of the transport path 56*h* with respect to that of the transport path 56*l*. It can be accomplished, for instance, through control and drive circuits such to slowing down or arresting the motor 71 and/or 72 so as to slowing down or arresting a sheet of the following document. Then, these circuits accelerate or restart the motor 71 and/or for transferring the sheet of the following document to the accumulating and forwarding device and the forming of the respective following document.

The cutting mechanisms 49*l* and 49*h* (FIGS. 3 and 5) can be as the cutting device described in the above mentioned Italian Patent N. 1.360.399 [EP 1 741 653]: in detail, such cutting mechanisms are of guillotine type, with single actuation by an eccentric mechanism and a servo controlled motor. The cutting mechanisms 49*l* and 49*h* include respective counter-blades 74*h* and 74*l* at different heights for the overlapped forms 26*l* and 26*r* and blades 76*h* and 76*l*, carried by a common plate, with cutting edges at different heights for cooperating with the counter-blades for the cutting of the forms 26*r*, 26*l*. The extraction members 51*l* and 51*h* and the extraction and trimming members are also of the type described in the Italian Patent N. 1.360.399 [EP 1 741 653] and include, each one, a pair of rollers which operate frictionally on a respective form emerging from the respective cutting mechanisms, and in which all the rollers are driven by the extraction motor 55.

Figure 9A:
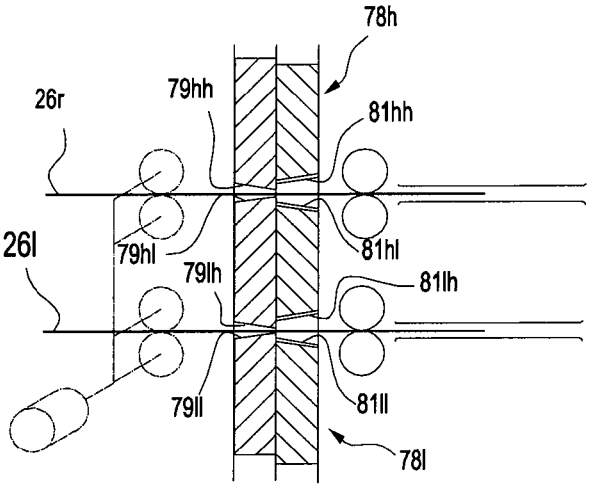
FIGS. 9*a*-9*c* show a variant of some components of the equipment of FIG. 3, in different operative conditions.
Figure 9B:
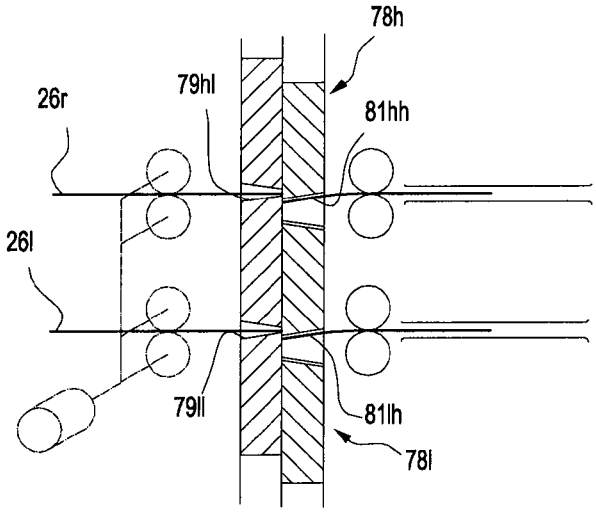
Figure 9C:
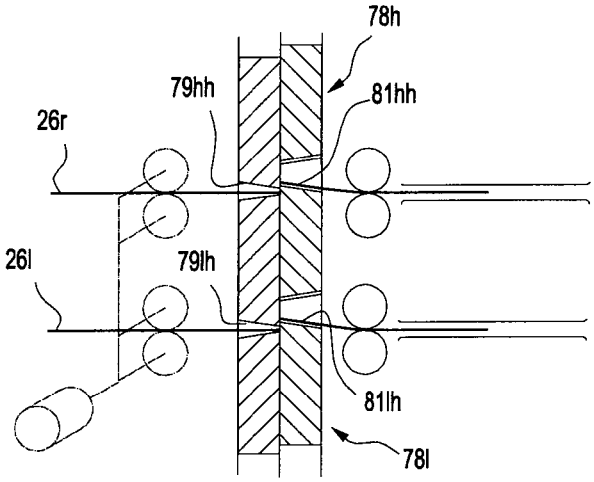

Modifications of the cutting mechanisms of the equipment 46, have been represented with 78*h* and 78*l* in the FIGS. 9*a*-9*c*. The cutting mechanisms 78*h* and 78*l* include reciprocating blades operate according to double effect cutting. Specifically, for each form 26*r*, 26*l* two counter-blades 79*hh* and 79*hl*; and 79*lh* and 79*ll* are provided, of contrast for the opposite faces of the form. The blades are also carried by a common plate and have, for each form, two cutting edges 81*hh* and 81*hl*; and 81*lh* and 811*l*, which are separated by a respective gap. The forms 26*r*; and 26*l* normally pass between the counter-blades and the gap of the cutting edge in the phases of shifting, and an intermediate position of the blades. For the cutting of the forms, the cutting edges 81*hl* and 81*ll* cooperate with the counter-blades 79*hl* and 79*ll* in a going run of the blades, as represented in FIG. 9*b*; in a return run, the cutting edge 81*hh* and 81*lh* cooperate with the counter-blades 79*hh* and 79*lh*, as represented in FIG. 9*c*.

Figure 10A:
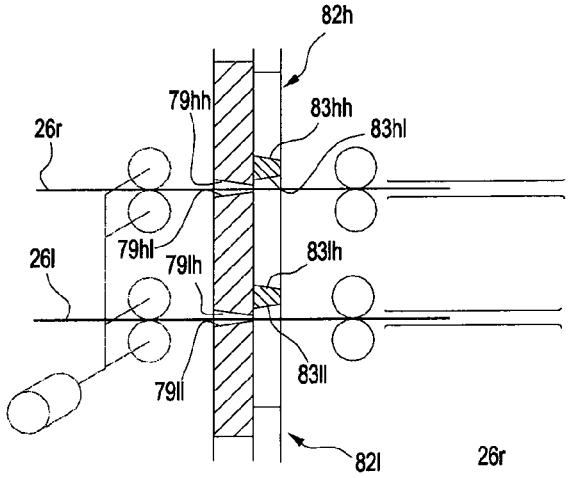
FIGS. 10*a*-10*d* show another variant of the components of FIG. 9*a*, in different operative conditions.
Figure 10B:
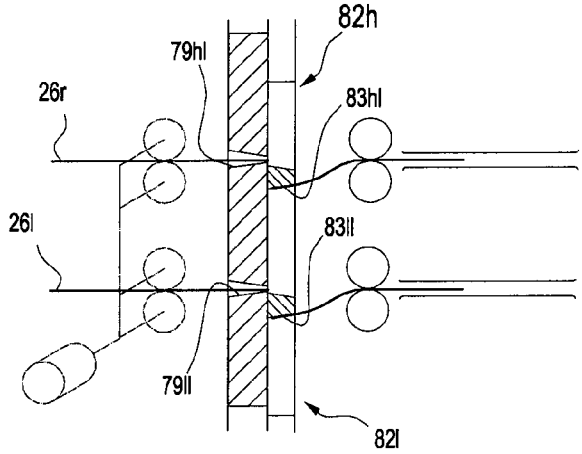
Figure 10C:
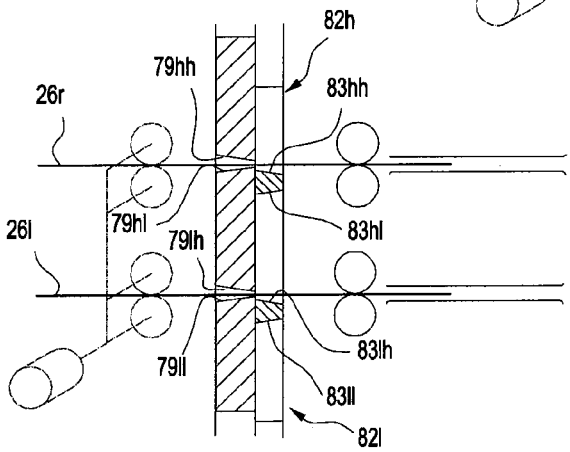
Figure 10D:
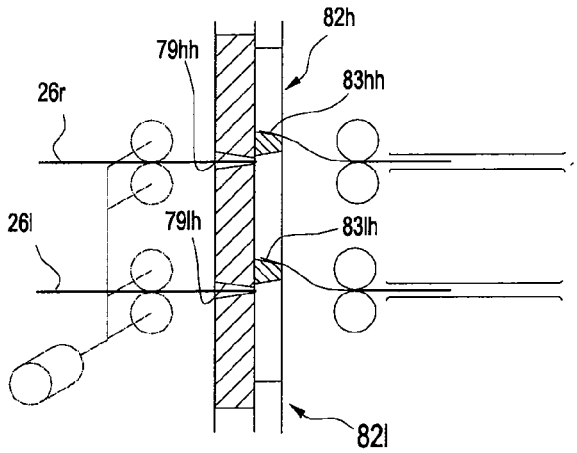

Other modifications of the cutting mechanisms of the equipment 46 have been represented with 82*h* and 82*l* in the FIGS. 10*a*-10*d*: Also the cutting mechanisms 82*h* and 82*l* operate according to double effect cutting and provide the two counter-blades 79*hh* and 79*hl*; and 79*lh* and 79*ll*, of contrast for the opposite faces of the form. The blades are of limited height and have, on opposite edges, two cutting edge 83*hh* and 83*hl*; and 83*lh* and 83*ll* for each form. The blades have two positions of rest, respectively high as represented in FIG. 10*a*, and low, as represented in FIG. 10*c*. In the phases of shifting, the forms 26*r*; and 26*l* normally pass between the counter-blades and below the cutting edges for the higher position of the blades and above the cutting edges for the lower position. For the cutting of the forms, the cutting edges 83*hl* and 83*ll* are adapted to cooperate with the counter-blades 79*hl* and 79*ll* in the going run of the blades, as represented in FIG. 10*b* while the cutting edges 83*hh* and 83*lh* are adapted to cooperate with the counter-blades 79*hh* and 79*lh* in the return run, as represented in FIG. 10*d*. With such structure, the operational speed of the cutting device results particularly increased.

Figure 11B:
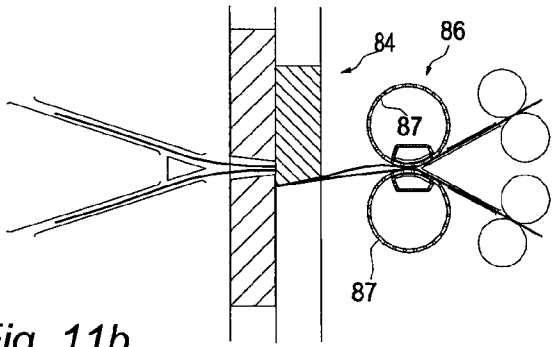
FIGS. 11*a* and 11*b* represent some components of another embodiment of the invention, in different operative conditions.
Figure 12:
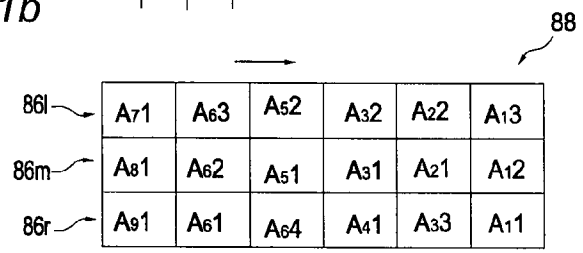
FIG. 12 is a schematic view of a continuous form according to a further arrangement of the sheets for the forming of documents.
Figure 11A:
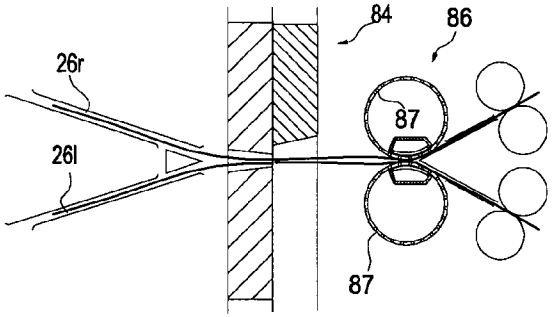
Figure 13:
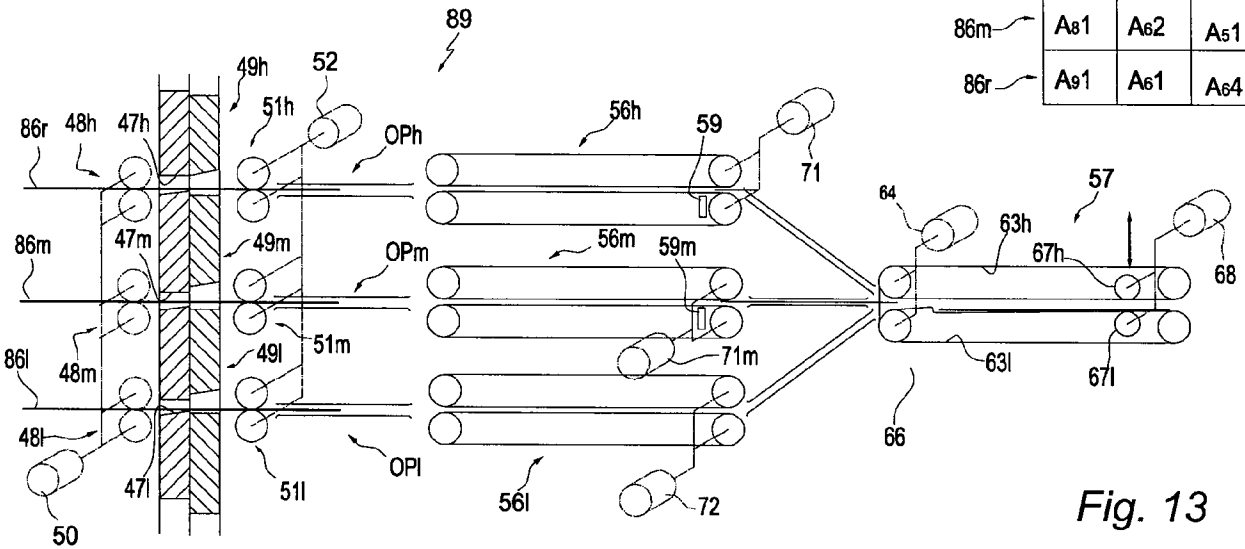
FIG. 13 represents a schematic view of a cutting equipment for separable sheets, according to the invention, for processing the forms of FIG. 12.

The equipment of the invention can also provide, as alternative, a single cutting device 84 (FIG. 11*a*) for the overlapped forms 26*r* and 26*l*. In this alternative, a separating mechanism 86 of the overlapped forms is provided downstream of the cutting device. The separating mechanism includes, for instance, aspirating rollers 87 for spacing the sheets after the cutting and addressing the sheets toward the above described transport paths. The cutting is executed on the overlapped forms (FIG. 11*b*) and the separation occurs after the cutting.

A cutting equipment according to the invention can also process continuous forms 88 with sheets and documents distributed according to three columns arranged side by side and longitudinally separable for three forms 86*l*, 86*m* and 86*r*. Such equipment, herein represented with 89, has three sections, respectively upper lower and median for the cutting of the forms 86*r*, 86*m* and 86*l*. The lower section and the upper section have inputs 47*h* and 47*l*, input mechanisms 48*h* and 48*l*, cutting mechanisms 49*h* and 49*l*, members of extraction and possible trimming 51*h* and 51*l* and transport paths 56*h* and 56*l* identical to the ones of the equipment 46 for the forms 86*r* and 86*l*. The median section has, in turn, similar component with an input 47*m*, an input mechanism 48*m*, a cutting device 49*m*, a member of extraction and possible trimming 51*m* and a transport path 56*m*, for the form 86*m*. Arresting devices 91 and 92 along the transport paths 56*h* and 56*m* are provided for arresting sheets non belonging to the document in formation and the accumulating and forwarding device 57 for the formed document The cutting mechanisms 49*h*, 49*m* and 49*l* are actuatable in synchronism for the single separation of the sheets from the overlapped forms. The transport paths 56*h*, 56*m* and 56*l* are arranged downstream of the cutting mechanisms and are provided for transporting the cut sheets along separated paths, arranged at different heights and confluent toward the accumulating and forwarding device 57 as in the case of the forms with two columns arranged side by side.

Naturally, the principle of the invention remaining the same, the embodiments and the details of construction can broadly be varied with respect to what has been described and illustrated, by way of non-limitative example, without by this departing from the ambit of the present invention.

We claim:

1. A transversal cutting equipment for sheets separable from overlapped continuous forms, wherein said forms are longitudinally divided from a basic continuous form for producing documents with a single sheet or with more sheets, wherein the documents and the respective sheets are printed according to a predetermined order, and wherein the sheets are transversely cut and longitudinally extracted and moved; the said equipment comprising:

a cutting device, actuatable for joined separation of the sheets from the overlapped forms;

an extractor device for extracting and moving forward sheets separated by the cutting device;

an accumulating and forwarding device for a partially formed document and a formed document;

transport paths, downstream of the extractor device, for transporting the separated sheets, along overlapped paths, to the accumulating and forwarding device; and differentiating means for modifying transport times of the sheets along one or more transport paths;

wherein the cutting device and the extractor device operate in a continuous way, while the accumulating and forwarding device collects the sheet or the sheets of a partially formed document and sends the sheet or the sheets upon the completion of the document; and wherein the differentiating means temporarily modify the transport times so that a cut sheet of a following document, different from the partially formed document, is transferred to the accumulating and forwarding device for the formation of the following document, substantially after the forwarding of the preceding document.

2. The cutting equipment according to claim 1, wherein the extractor device includes trimming members for longitudinal trimming sheets separated by the cutting device.

3. The cutting equipment according to claim 1, wherein the transport paths comprise, each one, motorized transport belts which, for the transport, are adapted to frictionally cooperate with the sheets of the cut forms.

4. The cutting equipment according to claim 1 wherein the differentiating means includes at least one arrest device arranged along a pre-defined transport path and wherein the arrest device temporarily arrests a sheet of the following document and releases said sheet of the following document for the transfer to the device of accumulation and the formation of the following document.

5. The cutting equipment according to claim 1, further including an actuating motor for a pre-defined transport path, wherein said differentiating means comprises control and drive circuits for said actuating motor, and wherein the control and drive circuits arrest the actuating motor for slowing down or arresting a sheet of the following document and accelerating or restarting the actuating motor for the transfer of the sheet of the following document to the device of accumulation and the formation of the following document.

6. The cutting equipment according to claim 1, wherein one of the transport paths moves the sheets according to a given law of motion, while the other transport path moves the sheets according to said given law of motion for the joint transport of the cut sheets, or according to a modified law of motion for the transfer of a sheet of a document different from the partially formed document.

7. The cutting equipment according to claim 1, wherein said equipment can process continuous basic forms in which the documents and the respective sheets are printed, on sided columns, according to a regressive order or, in alternative, said equipment can process basic forms in which the documents and the respective sheets are printed, on sided columns, according to a progressive order, and wherein the differentiating means modifies the transport times of the sheets of both the transport paths for temporarily modifying the transport times of the one or the other transport path in dependence on the regressive or progressive order of print of the processed form.

8. The cutting equipment according to claim 1 further including overlapped input passages for the continuous forms, wherein the cutting device includes cutting mechanisms, which are actuatable in synchronism for the single separation of the sheets from the continuous forms, while the extractor device includes extractor mechanisms which are actuatable in synchronism for the single extraction and movement of the sheets from the respective cutting mechanisms, and wherein the transport paths include respective upper transport belts and lower transport belts, which are arranged downstream of the respective extractor mechanisms for the transport of the cut sheets to the accumulating and forwarding device.

9. The cutting equipment according to claim 8, further comprising upper and lower guides, inclined downwardly and upwardly, respectively, for guiding, toward the accumulating and forwarding device, the sheets transported by the upper transport belts and the lower transport belts.

10. The cutting equipment according to claim 8, wherein said cutting mechanisms are of a guillotine type and comprise respective counter-blades at different heights for the overlapped forms and blades with cutting edges at different heights for cooperating with the counter-blades for the cutting of the two forms.

11. The cutting equipment according to claim 10, wherein said blades are formed on a common plate.

12. The cutting equipment according to claim 10, wherein each one of the extractor mechanisms comprises a pair of rollers which operate frictionally on a respective form emerging from the respective cutting mechanisms and wherein said rollers are driven by a common extraction motor.

13. The cutting equipment according to claim 8, wherein the cutting mechanisms operate double effect cuttings and wherein for each form are provided two counter-blades, of contrast for the opposite faces of the form, while the blades, for each form, have two cutting edges, and wherein said form normally passes between the counter-blades and the cutting edge in steps of shifting, while the cutting edges are provided for cooperating with the counter-blades for the cutting of each form in a forward stroke and in a rearward stroke of the said blades.

14. The cutting equipment according to claim 1 wherein the cutting device includes a single cutting mechanism for the cutting of the overlapped continuous forms, while the extraction device includes a mechanism of separation for the overlapped forms including aspiration rollers for extracting and spacing away the sheets after the cutting and addressing the cut sheets toward the transport paths.

15. The cutting equipment according to claim 1 wherein the accumulating and forwarding device comprises transport O-rings, respectively higher and lower, controlled by an accumulating motor and a step over ramp, advancing rollers controlled by an advancing motor and having possibility of mutual movement between a configuration of forming, in which the rollers are spaced away, and a configuration of forwarding in which the rollers engage the sheets of the formed document for the forwarding toward a following processing.

16. A transversal cutting equipment for sheets separable from overlapped continuous forms, wherein said forms are longitudinally divided from a basic continuous form for producing documents with a single sheet or with more sheets, wherein the documents and the respective sheets are printed according to a predetermined order, and wherein the sheets are transversely cut and longitudinally extracted and moved; the said equipment comprising:

a cutting device, actuatable for joined separation of the sheets from the overlapped forms;

an extractor device for extracting and moving forward sheets separated by the cutting device;

an accumulating and forwarding device for the document;

transport paths, downstream of the extractor device, for transporting the separated sheets, along overlapped paths, to the accumulating and forwarding device; and at least one arrest device arranged along a pre-defined transport path and actuatable for temporarily arresting a sheet of the pre-defined transport path;

wherein the cutting device and the extractor device operate in a continuous way, while the accumulating and forwarding device collects the sheet or the sheets of a partially formed document and sends the sheet or the sheets upon the completion of the document; and wherein said at least one arrest device is actuatable for arresting a cut sheet of a following document, different from the partially formed document and releasing the arrested sheet for being transferred to the accumulating and forwarding device for the formation of the following document.

17. A transversal cutting equipment for sheets separable from overlapped continuous forms, wherein said forms are longitudinally divided from a basic continuous form for producing documents with a single sheet or with more sheets, wherein the documents and the respective sheets are printed according to a predetermined order, and wherein the sheets are transversely cut and longitudinally extracted and moved; the said equipment comprising:

a cutting device, actuatable for joined separation of the sheets from the overlapped forms;

an extractor device for extracting and moving forward sheets separated by the cutting device;

transport paths, downstream of the extractor device, for transporting the separated sheets, along overlapped paths, to the accumulating and forwarding device;

an actuating motor for driving at least one of the pre-defined transport path; and control elements for said motor;

wherein the cutting device and the extractor device operate in a continuous way, while the accumulating and forwarding device collects the sheet or the sheets of a partially formed document and sends the sheet or the sheets upon the completion of the document; and wherein said control elements arrest the actuating motor for slowing down or arresting a sheet of a following document, different from the partially formed document the following document and accelerating or restarting the actuating motor for the transfer of the sheet of the following document to the device of accumulation and the formation of the following document.

18. A transversal cutting equipment for sheets separable from overlapped continuous forms, wherein said forms are longitudinally divided from a basic continuous form for producing documents with a single sheet or with more sheets, and wherein the documents and the respective sheets are printed according to a predetermined order; said equipment comprising:

overlapped input passages for the continuous forms cutting mechanisms, actuatable in synchronism for joined separation of the sheets from the overlapped forms;

an accumulating and forwarding device for the document;

transport paths, downstream of the cutting mechanisms, for transporting the cut sheets, along overlapped paths, to the accumulating and forwarding device; and differentiating means for modifying transport times of the sheets along one or more transport paths;

wherein the cutting mechanisms operate in a continuous way, while the accumulating and forwarding device collects the sheet or the sheets of a partially formed document and sends the sheet or the sheets upon the completion of the document; and wherein the differentiating means temporarily modifies the transport times so that a cut sheet of a following document, different from the partially formed document, is transferred to the accumulating and forwarding device for the formation of the following document, substantially after the forwarding of the preceding document, said cutting mechanisms being of guillotine type and comprising respective counter-blades at different heights adjacent to the respective input passages for the overlapped forms and blades with cutting edges at different heights for cooperating with the counter-blades for the cutting of the two forms; and the transport paths including transport belts arranged each one downstream of the cutting mechanism of a respective form for the transport of the cut sheets to the accumulating and forwarding device.

* * * * *